US007056394B2

(12) United States Patent
Inoue et al.

(10) Patent No.: US 7,056,394 B2
(45) Date of Patent: Jun. 6, 2006

(54) CU-BE BASE AMORPHOUS ALLOY

(75) Inventors: Akihisa Inoue, Sendai (JP); Tao Zhang, Sendai (JP)

(73) Assignee: Japan Science and Technology Agency, Saitama (JP)

( * ) Notice: Subject to any disclaimer, the term of this patent is extended or adjusted under 35 U.S.C. 154(b) by 0 days.

(21) Appl. No.: 10/344,004

(22) PCT Filed: Dec. 10, 2001

(86) PCT No.: PCT/JP01/10808

§ 371 (c)(1),
(2), (4) Date: Feb. 13, 2003

(87) PCT Pub. No.: WO02/086178

PCT Pub. Date: Oct. 31, 2002

(65) Prior Publication Data

US 2004/0099348 A1 May 27, 2004

(30) Foreign Application Priority Data

Apr. 19, 2001 (JP) ..... 2001-121266
Aug. 31, 2001 (JP) ..... 2001-264370

(51) Int. Cl.
*C22C 45/00* (2006.01)

(52) U.S. Cl. ..... 148/403; 148/304

(58) Field of Classification Search ..... 148/304, 148/403
See application file for complete search history.

(56) References Cited

U.S. PATENT DOCUMENTS 5,368,659 A 11/1994 Peker et al.
5,618,359 A 4/1997 Lin et al.

FOREIGN PATENT DOCUMENTS

JP 59-126739 7/1984
JP 2002-256401 9/2002

*Primary Examiner*—Sikyin Ip
(74) *Attorney, Agent, or Firm*—Westerman, Hattori, Daniels & Adrian, LLP.

(57) ABSTRACT

The present invention provides a Cu—Be based amorphous alloy comprising an amorphous phase of 50% or more by volume fraction. This alloy has a composition represented by the following formula: $Cu_{100-a-b}Be_a(Zr_{1-x-y}Hf_xTi_y)_b$. In the formula, "a" and "b" represent atomic percentages which are $0<a\leqq 20$ and $20\leqq b\leqq 40$, and "x" and "y" represent atomic fractions which are $0\leqq x\leqq 1$ and $0\leqq y\leqq 0.8$. The alloy may contain a small amount of one or more elements selected from the group consisting of Fe, Cr, Mn, Ni, Co, Nb, Mo, W, Sn, Al, Ta and rare-earth elements and/or the group consisting of Ag, Pd, Pt and Au. The alloy has a wide supercooled-liquid temperature range and a large reduced glass transition temperature (Tg/Tm) to achieve a high thermal stability against crystallization or a high glass-forming ability.

2 Claims, No Drawings

CU-BE BASE AMORPHOUS ALLOY

FIELD OF THE INVENTION

The present invention relates to a Cu—Be based amorphous alloy having a high glass-forming ability, enhanced mechanical properties and an excellent workability.

BACKGROUND OF THE INVENTION

A Cu—Be alloy is formed by adding beryllium to copper so as to provide a Cu based alloy having age-hardening properties. While a Cu—Be alloy containing 2% of Be has a relatively low tensile strength of about 0.5 GPa just after a solution heat treatment, the strength will be increased up to 1.5 GPa through age hardening. By taking advantages of its age-hardening properties and excellent corrosion resistance, the Cu—Be alloy containing 2% of Be is widely used as high-performance and high-reliability springs in various fields such as electronic industries and telecommunication equipment industries. It can also be used as other various products such as molding dies for plastic materials and safety machine tools free from spark caused by a mechanical impact. A Cu—Be alloy containing 1% or less of Be is used to utilize its high electric conductivity.

Heretofore, particular alloys such as Fe-based, Co-based and Ni-based alloys have been able to be formed in an amorphous phase to obtain an excellent strength, elasticity and corrosion resistance superior to those in its crystalline phase. It has also been known that the amorphous alloys exhibit excellent superplastic-forming properties in a supercooled liquid temperature range.

As an amorphous alloy containing a relatively large amount of Cu, there has been known a glassy alloy containing Zr, Ti, Cu and Ni, which is disclosed in domestic republication of PCT international publication for patent applications Ser. Nos. JP10-512014 and JP8-508545. In this context, the inventors have achieved an invention of an improved Cu-based amorphous alloy and applied for a patent (Japanese Patent Application No. 2000-397007).

The conventional Cu—Be crystalline alloy can be formed into a bulk alloy but with a lower strength than that of an amorphous alloy. Besides, a viscous-flow-like superplastic forming cannot be applied to such a Cu—Be crystalline alloy. On the other hand, it has been known that in a heating process, a particular amorphous alloy exhibits a supercooled liquid phase allowing the viscous-flow-like superplastic forming, before the initiation of crystallization. In this temperature range allowing the formation of the supercooled liquid phase, the amorphous alloy can be formed into a product having any desired shape through a plastic forming. Further, an alloy having a high glass-forming ability can be formed as a bulk amorphous alloy through a copper-mold casting method.

SUMMARY OF THE INVENTION

It is therefore an object of the present invention to provide a Cu—Be based amorphous alloy with an amorphous-phase volume fraction of 50% or more, having a wide supercooled-liquid temperature range and a high reduced-glass transition temperature (Tg/Tm) to exhibit a high thermal stability against crystallization so as to obtain a high glass-forming ability, enhanced mechanical properties, and excellent workability or working properties.

In order to achieve the above object, the inventors made researches for the purpose of providing a metallic glass material capable of forming a bulk metallic glass therefrom. In result, the inventors have found out that a Cu—Be—Zr—Ti—Hf based alloy can exhibit a supercooled liquid temperature range of 25 K or more to provide a Cu—Be based amorphous alloy, e.g. a Cu—Be based amorphous alloy bar having a diameter (thickness) of 1 mm or more, having a high glass-forming ability, high strength, high elasticity and excellent workability, and finally accomplished the present invention.

Specifically, according a first aspect of the present invention, there is provided a Cu—Be based amorphous alloy comprising an amorphous phase of 50% or more by volume fraction. This alloy has a composition represented by the following formula: $Cu_{100-a-b}Be_a(Zr_{1-x-y}Hf_xTi_y)_b$. In the formula, "a" and "b" represent atomic percentages which are $0<a\leqq 20$ and $20\leqq b\leqq 40$, and "x" and "y" represent atomic fractions which are $0\leqq x\leqq 1$ and $0\leqq y\leqq 0.8$.

According a second aspect of the present invention, there is provided a Cu—Be based amorphous alloy comprising an amorphous phase of 50% or more by volume fraction. This alloy has a composition represented by the following formula: $Cu_{100-a-b}Be_a(Zr_{1-x-y}Hf_xTi_y)_b$In the formula, "a" and "b" represent atomic percentages which are $5<a\leqq 10$ and $30\leqq b\leqq 40$, and "x" and "y" represent atomic fractions which are $0\leqq x\leqq 1$ and $0\leqq y\leqq 0.8$.

According a third aspect of the present invention, there is provided a Cu—Be based amorphous alloy comprising an amorphous phase of 50% or more by volume fraction. This alloy has a composition represented by the following formula: $Cu_{100-a-b-c-d}Be_a(Zr_{1-x-y}Hf_xTi_y)_bM_cT_d$. In the formula, M represents one or more elements selected from the group consisting of Fe, Cr, Mn, Ni, Co, Nb, Mo, W, Sn, Al, Ta and rare-earth elements; T represents one or more elements selected from the group consisting of Ag, Pd, Pt and Au; "a", "b", "c" and "d" represent atomic percentages which are $0<a\leqq 20$, $20\leqq b\leqq 40$, $0<c\leqq 5$ and $0<d\leqq 10$; and "x" and "y" represent atomic fractions which are $0\leqq x\leqq 1$ and $0\leqq y\leqq 0.8$.

According a fourth aspect of the present invention, there is provided a Cu—Be based amorphous alloy comprising an amorphous phase of 50% or more by volume fraction. This alloy has a composition represented by the following formula: $Cu_{100-a-b-c-d}Be_a(Zr_{1-x-y}Hf_xTi_y)_bM_cT_d$. In the formula, M represents one or more elements selected from the group consisting of Fe, Cr, Mn, Ni, Co, Nb, Mo, W, Sn, Al, Ta and rare-earth elements; T represents one or more elements selected from the group consisting of Ag, Pd, Pt and Au; "a", "b", "c" and "d" represent atomic percentages which are $5<a\leqq 10$, $30\leqq b\leqq 40$, $0<c\leqq 5$ and $0<d\leqq 10$; and "x" and "y" represent atomic fractions which are $0\leqq x\leqq 1$ and $0\leqq y\leqq 0.8$.

When the alloy of the present invention was processed through a copper-mold casting method and subjected to a thermal analysis, a heat generation arising from a significant glass transition and crystallization was observed. This analysis showed that a metallic glass can be prepared by the copper-mold casting method.

A metallic glass ingot having a diameter (thickness) of 1.0 mm or more can be prepared from the amorphous alloy of the present invention. If the alloy composition is out of the range defined in the present invention, the glass-forming ability will be deteriorated to facilitate the creation and growth of crystal nuclei in the course of solidification from its molten state and form a mixture of glass and crystalline phases. No glass phase or only a crystalline phase is formed in an alloy having a composition quite different from the range defined in the present invention.

The Cu—Be based amorphous alloy of the first to fourth aspects of the present invention may have a supercooled liquid temperature range ΔTx of 25 K or more. This supercooled liquid temperature range ΔTx is represented by the following formula: ΔTx=Tx−Tg. In the formula, Tx represents the crystallization initiation temperature of the alloy, and Tg represents the glass transition temperature of the alloy.

Further, the alloy of the present invention may have a reduced glass transition temperature of 0.58 or higher. This reduced glass transition temperature is represented by the following formula: Tg/Tm. In this formula, Tm represents the melting temperature of the alloy.

The alloy of the present invention has a large critical thickness to be formed as an amorphous phase, and can be formed into a bar or plate material which includes an amorphous phase volume fraction of 50% or more, particularly 90% or more and has a diameter or thickness of 1 mm or more, through a copper-mold casting process.

The term "supercooled liquid temperature range" herein means the difference between a glass transition temperature of the alloy and a crystallization initiation temperature of the alloy, which are determined by a differential scanning calorimetry (DSC) performed at a heating rate of 40 K/minute. The "supercooled liquid temperature range" is a value indicative of resistibility against crystallization which is equivalent to thermal stability of amorphous state, glass-forming ability or workability. The alloy of the present invention has a supercooled liquid temperature range of 25 K or more.

The term "reduced glass transition temperature" herein means a ratio of the glass transition temperature (Tg) to a melting temperature (Tm) of the alloy, which is determined by a differential thermal analysis (DTA) performed at a heating rate of 5 K/minute. The "reduced glass transition temperature" is a value indicative of the glass-forming ability.

DESCRIPTION OF THE PREFERRED EMBODIMENT

One embodiment of the present invention will now be described.

A Cu—Be based amorphous alloy of the present invention comprises fundamental elements of Zr, Hf and Ti. The atomic percentage of Zr is in the range of zero to 40%, preferably 20 to 30%. The atomic percentage of Hf is in the range of zero to 40%, preferably 20 to 30%. The atomic percentage of Ti is in the range of zero to 32%, preferably 10 to 20%. If the atomic percentage of Zr, Hf or Ti is out of the above range, no supercooled liquid range will be exhibited and the value of Tg/Tm will be 0.56 or lower, which leads to deteriorated glass-forming ability of the alloy.

The total atomic percentage of Zr, Hf and Ti is set in the range of 20 to 40%. If this total atomic percentage is less than 20% or greater than 40%, the glass-forming ability will be deteriorated to form no bulk amorphous material. More preferably, the total atomic percentage of Zr, Hf and Ti is set in the range of 30 to 40%.

In the Cu—Be based amorphous alloy of the present invention, Be serves as an element for enhancing the glass-forming ability to provide an increased strength in a resulting amorphous alloy. Be is added at an atomic percentage of 20% or less. If this atomic percentage is greater than 20%, the glass-forming ability will be deteriorated. Preferably, the atomic percentage of Be is set in the range of 5 to 10%.

A part of Cu may be substituted with a small amount of one or more elements selected from the group consisting of Fe, Cr, Mn, Ni, Co, Nb, Mo, W, Sn, Al, Ta and rare-earth elements (Y, Gd, Tb, Dy, Sc, La, Ce, Pr, Nd, Sm, Eu and Ho). The addition of these elements can effectively improve the mechanical strength of the alloy but causes deterioration in the glass-forming ability. Thus, it is desired to add these elements at the atomic percentage of 5% or less.

Further, a part of Cu may be substituted with one or more elements selected from the group consisting of Ag, Pd, Au and Pt at an atomic percentage of 10% or less. The supercooled liquid temperature range can be slightly expanded by substituting Cu with these elements. However, if these elements are added at an atomic percentage of more than 10%, the supercooled liquid temperature range will be less than 25 K, resulting in deteriorated glass-forming ability.

The Cu—Be based amorphous alloy of the present invention can be cooled and solidified from its molten state through any suitable conventional method such as a single-roll melt spinning method, twin-roll melt spinning method, in-rotating liquid spinning method or atomization method to provide an amorphous alloy in the form of a ribbon, thin strip, filament, grain or powder. In addition, a high glass-forming ability of the Cu—Be based amorphous alloy of the present invention makes it possible to obtain a bulk amorphous alloy having any desired shape through a copper-mold casting method, as well as the above conventional methods.

For example, in a typical copper-mold casting method, after melting a master alloy having the alloy composition defined in the present invention within a silica tube kept under argon atmosphere, the molten metal can be filled in a copper mold at an injection pressure of 0.5 to 1.5 kg·f/cm$^2$ and solidified to obtain an amorphous alloy ingot. Alternatively, any other suitable method such as a high-pressure die-casting method or a squeeze-casting method may be used.

EXAMPLE

Examples of the present invention will be described below. For each of materials as master alloys having alloy compositions in Table 1 (Inventive Examples 1 to 14 and Comparative Examples 1 to 6) and Table 2 (Inventive Examples 15 to 26, Comparative Examples 7 to 10), after melting the master alloy through an arc-melting method, a bar-shaped sample was prepared through a copper-mold casting method to determine a critical thickness for glass-formation. The amorphous phase of the bar-shaped sample was confirmed through an X-ray diffraction method. A compression test piece was prepared, and the test piece was subjected to a compression test using an Instron-type testing machine to evaluate its compressive fracture strength (σf). These evaluation results are shown in Tables 1 and 2.

TABLE 1

| | Alloy Composition | Compressive Strength (σ f) (MPa) | Critical Thickness (mm) |
|---|---|---|---|
| Inventive Example 1 | $Cu_{57}Zr_{28.5}Ti_{9.5}Be_5$ | 2350 | 5 |
| Inventive Example 2 | $Cu_{54}Zr_{27}Ti_9Be_{10}$ | 2400 | 5 |
| Inventive Example 3 | $Cu_{51}Zr_{25.5}Ti_{8.5}Be_{15}$ | 2300 | 1 |
| Inventive Example 4 | $Cu_{48}Zr_{24}Ti_8Be_{20}$ | 2350 | 1 |
| Inventive Example 5 | $Cu_{57}Zr_{28}Ti_9Nb_1Be_5$ | 2300 | 5 |
| Inventive Example 6 | $Cu_{57}Zr_{27}Ti_9Nb_2Be_5$ | 2300 | 5 |
| Inventive Example 7 | $Cu_{57}Zr_{28}Ti_9Pd_1Be_5$ | 2300 | 5 |
| Inventive Example 8 | $Cu_{57}Zr_{19}Ti_9Be_5$ | 2400 | 4 |
| Inventive Example 9 | $Cu_{54}Zr_{18}Ti_{18}Be_{10}$ | 2200 | 4 |
| Inventive Example 10 | $Cu_{55}Zr_{28}Ti_{9.5}Be_{7.5}$ | 2400 | 5 |
| Inventive Example 11 | $Cu_{57}Zr_{38}Be_5$ | 2200 | 2 |

TABLE 1-continued

| | Alloy Composition | Compressive Strength (σ f) (MPa) | Critical Thickness (mm) |
|---|---|---|---|
| Inventive Example 12 | $Cu_{57}Zr_{38}Be_5$ | 2350 | 2 |
| Inventive Example 13 | $Cu_{57}Zr_{28}Ti_{10}Be_5$ | 2200 | 2 |
| Inventive Example 14 | $Cu_{57}Hf_{28}Ti_{10}Be_5$ | 2300 | 2 |
| Comparative Example 1 | $Cu_{60}Zr_{30}Ti_{10}$ | 2115 | 4 |
| Comparative Example 2 | $Cu_{60}Hf_{30}Ti_{10}$ | 2143 | 4 |
| Comparative Example 3 | $Cu_{60}Zr_{20}Ti_{20}$ | 2015 | 3 |
| Comparative Example 4 | $Cu_{60}Hf_{20}Ti_{20}$ | 2078 | 4 |
| Comparative Example 5 | $Cu_{60}Zr_{15}Hf_{15}Ti_{10}$ | 2100 | 3 |
| Comparative Example 6 | $Cu_{55}Zr_{25}Ti_{20}$ | 1970 | 3 |

TABLE 2

| | Alloy Composition | Compressive Strength (σ f) (MPa) | Critical Thickness (mm) |
|---|---|---|---|
| Inventive Example 15 | $Cu_{58}Be_3Zr_{17}Hf_{12}Ti_8Fe_2$ | 2450 | 3 |
| Inventive Example 16 | $Cu_{58}Be_3Zr_{17}Hf_{12}Ti_8Cr_2$ | 2500 | 2 |
| Inventive Example 17 | $Cu_{58}Be_3Zr_{17}Hf_{12}Ti_8Mn_2$ | 2600 | 4 |
| Inventive Example 18 | $Cu_{58}Be_3Zr_{17}Hf_{12}Ti_8Gd_2$ | 2400 | 2 |
| Inventive Example 19 | $Cu_{58}Be_3Zr_{17}Hf_{12}Ti_8Nd_2$ | 2500 | 3 |
| Inventive Example 20 | $Cu_{58}Be_3Zr_{17}Hf_{12}Ti_8La_2$ | 2600 | 3 |
| Inventive Example 21 | $Cu_{58}Be_3Zr_{17}Hf_{10}Ti_8W_2Al_2$ | 2600 | 3 |
| Inventive Example 22 | $Cu_{58}Be_3Zr_{17}Hf_{10}Ti_8Ta_2Sn_2$ | 2610 | 3 |
| Inventive Example 23 | $Cu_{58}Be_3Zr_{17}Hf_{10}Ti_8Al_2Sn_2$ | 2500 | 3 |
| Inventive Example 24 | $Cu_{58}Be_3Zr_{17}Hf_{10}Ti_8Sc_2Pd_2$ | 2500 | 3 |
| Inventive Example 25 | $Cu_{58}Be_3Zr_{17}Hf_{10}Ti_8Sm_2Ag_2$ | 2660 | 3 |
| Inventive Example 26 | $Cu_{58}Be_3Zr_{17}Hf_{10}Ti_8Ho_2Au_2$ | 2570 | 3 |
| Comparative Example 7 | $Cu_{70}Zr_{20}Ti_{10}$ | | 0.5 |
| Comparative Example 8 | $Cu_{70}Hf_{20}Ti_{10}$ | | 0.3 |
| Comparative Example 9 | $Cu_{70}Zr_{10}Hf_{10}Ti_{10}$ | | 0.5 |
| Comparative Example 10 | $Cu_{60}Zr_{40}$ | | 0.3 |

As seen in Tables 1 and 2, the amorphous alloy containing Be in each Inventive Example can be formed into an amorphous alloy bar which has a diameter of 1 mm or more, even 3 mm or more, and a compressive fracture strength (σf) of 2200 MPa or more.

INDUSTRIAL APPLICABILITY

As mentioned above, a Cu—Be based amorphous alloy of the present invention makes it possible to facilitate the production of a bar-shaped sample having a diameter (thickness) of 1 mm or more through a copper-mold casting method. The obtained amorphous alloy exhibits a supercooled liquid temperature range ΔTx of 25 K or more, and has a high strength. Thus, the present invention can provide a practically variable Cu—Be based amorphous alloy having a high glass-forming ability, enhanced mechanical properties and excellent workability.

What is claimed is:

1. A Cu—Be based amorphous alloy product consisting of an alloy comprising an amorphous phase of 90% or more by volume fraction, said alloy consisting of a composition represented by the following formula:

$Cu_{100-a-b}Be_a(Zr_{1-x-y}Hf_xTi_y)_b$, wherein a and b represent atomic percentages which are $3 \leqq a \leqq 5$, $20 \leqq b \leqq 40$, and x and y represent atomic fractions which are $0 \leqq x+y \leqq 1$ and $0 \leqq y \leqq 0.25$, wherein said amorphous alloy having a supercooled liquid temperature range ΔTx of 25 K or more, said supercooled liquid temperature range ΔTx being represented by the formula: ΔTx=Tx−Tg, wherein Tx represents a crystallization initiation temperature of said alloy, and Tg represents a glass transition temperature of said alloy, wherein said amorphous alloy having a reduced glass transition temperature of 0.58 or higher, said reduced glass transition temperature being represented by the following formula:

Tg/Tm, wherein Tg represents a glass transition temperature of said alloy, and Tm represents a melting temperature of said alloy, and wherein said amorphous alloy product having a shape with a diameter or thickness of 1 mm or more, made through a copper-mold casting method, and exhibits a compressive fracture strength $\sigma_f$ of 2200 MPa.

2. A Cu—Be based amorphous alloy product consisting of an alloy comprising an amorphous phase of 90% or more by volume fraction, said alloy consisting of a composition represented by the following formula:

$Cu_{100-a-b-c-d}Be_a(Zr_{1-x-y}Hf_xTi_y)_bM_cT_d$, wherein M represents one or more elements selected from the group consisting of Fe, Cr, Mn, Co, Nb, Mo, W, Sn, Al, Ta and rare-earth elements, T represents one or more elements selected from the group consisting of Ag, Pd, Pt and Au, and a, b, c and d represent atomic percentages which are $3 \leqq a \leqq 5$, $20 \leqq b \leqq 40$, $0 < c \leqq 5$ and $0 \leqq d \leqq 10$, and x and y represent atomic fractions which are $0 \leqq x+y \leqq 1$ and $0 \leqq y \leqq 0.25$, wherein said amorphous alloy having a supercooled liquid temperature range ΔTx of 25 K or more, said supercooled liquid temperature range ΔTx being represented by the formula: ΔTx=Tx−Tg, wherein Tx represents a crystallization initiation temperature of said alloy, and Tg represents a glass transition temperature of said alloy, wherein said amorphous alloy having a reduced glass transition temperature of 0.58 or higher, said reduced glass transition temperature being represented by the following formula:

Tg/Tm, wherein Tg represents a glass transition temperature of said alloy, and Tm represents a melting temperature of said alloy, and wherein said amorphous alloy product having a shape with a diameter or thickness of 1 mm or more, made through a copper-mold casting method, and exhibits a compressive fracture strength $\sigma_f$ of 2200 MPa.

* * * * *